US009771641B2

(12) United States Patent
Koskenniska

(10) Patent No.: US 9,771,641 B2
(45) Date of Patent: Sep. 26, 2017

(54) AUSTENITIC STAINLESS STEEL

(71) Applicant: OUTOKUMPU OYJ, Espoo (FI)

(72) Inventor: Janne Koskenniska, Tornio (FI)

(73) Assignee: Outokumpu Oyj, Helsinki (FI)

( * ) Notice: Subject to any disclaimer, the term of this patent is extended or adjusted under 35 U.S.C. 154(b) by 14 days.

(21) Appl. No.: 14/431,048

(22) PCT Filed: Sep. 26, 2013

(86) PCT No.: PCT/FI2013/050940
§ 371 (c)(1),
(2) Date: Mar. 25, 2015

(87) PCT Pub. No.: WO2014/049209
PCT Pub. Date: Apr. 3, 2014

(65) Prior Publication Data

US 2015/0247228 A1 Sep. 3, 2015

(30) Foreign Application Priority Data

Sep. 27, 2012 (FI) ..... 20120319

(51) Int. Cl.

| | |
|---|---|
| ***C22C 38/02*** | (2006.01) |
| ***C22C 38/58*** | (2006.01) |
| ***C22C 38/42*** | (2006.01) |
| ***C22C 38/44*** | (2006.01) |
| ***C22C 38/52*** | (2006.01) |
| ***C22C 38/00*** | (2006.01) |
| ***C22C 38/04*** | (2006.01) |
| *C21D 6/00* | (2006.01) |

(52) U.S. Cl.
CPC ..... *C22C 38/58* (2013.01); *C22C 38/001* (2013.01); *C22C 38/02* (2013.01); *C22C 38/04* (2013.01); *C22C 38/42* (2013.01); *C22C 38/44* (2013.01); *C22C 38/52* (2013.01); *C21D 6/004* (2013.01)

(58) Field of Classification Search
CPC ..... C21D 6/004; C22C 38/00
USPC ..... 420/38, 43–46; 148/325
See application file for complete search history.

(56) References Cited

U.S. PATENT DOCUMENTS

| | | | | |
|---|---|---|---|---|
| 4,528,046 | A | 7/1985 | Yamamoto et al. | |
| 5,429,688 | A | 7/1995 | Barbosa et al. | |
| 8,337,749 | B2 * | 12/2012 | Bergstrom | C22C 38/42 148/325 |
| 2010/0047105 | A1 | 2/2010 | Bergstrom et al. | |

FOREIGN PATENT DOCUMENTS

| | | | | |
|---|---|---|---|---|
| JP | EP 0151487 A2 * | 8/1985 | ..... | C22C 38/001 |

OTHER PUBLICATIONS

International Search Report from corresponding PCT Application No. PCT/FI2013/050940, dated Jan. 16, 2014, 5 pgs.

* cited by examiner

*Primary Examiner* — Jie Yang
(74) *Attorney, Agent, or Firm* — Chernoff Vilhauer LLP

(57) ABSTRACT

The invention relates to an austenitic stainless steel with improved pitting corrosion resistance and improved strength. The stainless steel contains in weight % less than 0, % carbon (C), 0,2-0,6% silicon (Si), 1.0-2.0% manganese (Mn), 19.0-21.0% chromium (Cr), 7.5-9.5% nickel (Ni), 0.4-1.4% molybdenum (Mo), less than 1.0% copper (Cu), 0.10-0.25% nitrogen (N), optionally less than 1.0% cobalt (Co), optionally less than 0.006% boron (B), and the rest being iron (Fe) and inevitable impurities.

12 Claims, No Drawings

AUSTENITIC STAINLESS STEEL

CROSS REFERENCE TO RELATED APPLICATIONS

This is a national stage application filed under 35 USC 371 based on International Application No. PCT/FI2013/050940 filed Sep. 26, 2013 and claims priority under 35 USC 119 of Finnish Patent Application No. 20120319 filed 27 Sep. 2012.

STATEMENT REGARDING FEDERALLY SPONSORED RESEARCH OR DEVELOMENT

Not Applicable.

THE NAMES OF THE PARTIES TO A JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVESTOR

Not Applicable.

BACKGROUND OF THE INVENTION

Not applicable.

BRIEF SUMMARY OF THE INVENTION

Not applicable.

BRIEF DESCRIPTION OF SEVERAL VIEWS OF THE DRAWINGS

Not applicable.

DETAILED DESCRIPTION OF THE INVENTION

This invention relates to an austenitic stainless steel which has improved pitting corrosion resistance and improved strength with lower manufacturing costs than the standardized 316L/1.4404 type austenitic stainless steel.

The standardized 316L /1.4404 austenitic stainless steel typically contains in weight % 0.01-0.03% carbon, 0.25-0.75% silicon, 1-2% manganese, 16.8-17.8% chromium, 10-10.5% nickel, 2.0-2.3% molybdenum, 0.2-0.64% copper, 0.10-0.40% cobalt, 0.03-0.07% nitrogen and 0.002-0.0035% boron, the rest being iron and inevitable impurities. The proof strength $R_{p0.2}$ for the standardized 316L/1.4404 austenitic stainless steel is typically 220-230 MPa and respectively $R_{p1.0}$ 260-270 MPa, while the tensile strength $R_m$ is 520-530 MPa. Typical values for coil and sheet products having a 2B finish surface are $R_{p0.2}$ 290 MPa, $R_{p1.0}$ 330 MPa and $R_m$ 600 MPa. Because nickel and molybdenum are expensive elements and at least the price of nickel is volatile the manufacturing costs for the 316L/1.4404 type austenitic stainless steel are high.

It is known from the CN patent application 101724789 an austenitic stainless steel which contains in weight % less than 0.04% carbon, 0.3-0.9% silicon, 1-2% manganese, 16-22% chromium, 8-14% nickel, less than 4% molybdenum, 0.04-0.3% nitrogen, 0.001-0.003% boron and less than 0.3% one or more of rare earth elements cerium (Ce), dysprosium (Dy), yttrium (Y) and neodymium (Nd), the rest being iron and inevitable impurities. The alloy of this CN patent application 101724789 is compared with 316L saying that the alloy has good mould toughness and improved yield strength, while plasticity and the pitting corrosion maintaining at the same level. However, the CN patent application 101724789 does not say anything about the manufacturing costs.

The JP patent application 2006-291296 relates to an austenitic stainless steel which contains in weight % less than 0.03% carbon, less than 1.0% silicon, less than 5% manganese, 15-20% chromium, 5-15% nickel, less than 3% molybdenum, less than 0.03% nitrogen, 0.0001-0.01% boron, and satisfies the $M_{d30}$ temperature being between −60° C. and −10° C. and the SFI (Stacking-fault difficulty index) value ≥30, which values are calculated using the formulas for $M_{d30}$=551-462(C+N)−9.2Si−8.1Mn−29(Ni+Cu)−13.7Cr−18.5Mo and for SFI=2.2Ni+6Cu−1.1Cr−13Si−1.2Mn+32. The JP patent application 2006-291296 mentions nickel as an expensive element, the maximum content being preferably 13 weight %.

The WO publication 2009/082501 describes an austenitic stainless steel which contains in weight % up to 0.08% C, 3.0-6.0% Mn, up to 2.0% Si, 17.0-23.0% Cr, 5.0-7.0% Ni, 0.5-3.0% Mo, up to 1.0% Cu, 0.14-0.35% N, up to 4.0% W, up to 0.008% B, up to 1.0% Co, the rest being iron and incidental impurities. The WO publication 2011/053460 relates to a similar austenitic stainless steel containing in weight % up to 0.20% C, 2.0 to 9.0% Mn, up to 2.0% Si, 15.0 to 23.0% Cr, 1.0 to 9.5% Ni, up to 3.0% Mo, up to 3.0% Cu, 0.05 to 0.35% N, (7.5(% C) <(% Nb+% Ti+% V+% Ta+% Zr) <1.5, the rest being iron and incidental impurities. These austenitic stainless steels contain manganese more than 2 weight % which is not typical for austentic stainless steels of the 300 series. This high manganese content also causes problems in the circulation of steel scrap because the circulated steel having high manganese content does not maintain the value in the pricing of raw material.

The GB patent 1,365,773 relates to an austenitic stainless steel capable of withstanding high sustained loads at elevated temperatures, i.e. an austenitic stainless steel of improved creep strength properties. The creep strength properties can be considerably improved if vanadium and nitrogen are introduced into the steel in certain proportions together with boron. The vanadium (V) content by weight % is 3 to 4 times the nitrogen (N) content. Then a finely dispersed nitride phase is precipitated out in the austenitic matrix comprising mainly the simple vanadium nitride (VN). This nitride phase has been found to strengthen the creep strength of austenite grains quite considerably. The GB patent 1,365,773 also mentions that nickel and possibly manganese should be present in the steel so that they together are capable of ensuring a pure austenitic structure in the matrix. Based on that if the manganese content is below 3 weight % the nickel content must be increased to guarantee the stability of the austenitic structure in the matrix. The nickel content should therefore be at least 8 weight % and suitably at least 12 weight %.

The object of the present invention is to eliminate some drawbacks of the prior art and to achieve an improved austenitic stainless steel which manufacturing costs are cheaper because high price elements are partly substituted by low price elements without diminishing and more like improving the properties, such as pitting corrosion resistance and strength. The essential features of the present invention are enlisted in the appended claims.

The present invention relates to an austenitic stainless steel which contains in weight % less than 0.03% carbon (C), 0.2-0.6% silicon (Si), 1.0-2.0% manganese (Mn), 19.0-21.0% chromium (Cr), 7.5-9.5% nickel (Ni), 0.4-1.4% molybdenum (Mo), less than 1.0% copper (Cu), 0.10-0.25% nitrogen (N), optionally less than 1.0% cobalt, optionally less than 0.006% boron (B), and the rest being iron (Fe) and inevitable impurities.

When comparing the austenitic stainless steel of the invention with the 316L/1.4404 type austenitic stainless steel, the chromium content according to the invention is higher at least partly substituting molybdenum as well as the nitrogen content is higher at least partly substituting molybdenum as well as nickel. In spite of these substitutions the $Cr_{eq}/Ni_{eq}$ ratio between the chromium equivalent and the nickel equivalent is kept essentially at the similar or lower level when compared to the $Cr_{eq}/Ni_{eq}$ ratio in the reference 316L/1.4404 type austenitic stainless steel. The delta ferrite (δ-ferrite) content is kept between 2-9% after high temperature annealing and fast cooling as well as in a solidification structure after welding. This feature diminishes problems related to hot working and welding i.e. hot cracking. The proof strength $R_{p0.2}$ for the austenitic stainless steel in accordance with the invention is typically 320-450 MPa and respectively $R_{p1.0}$ 370-500 MPa, while the tensile strength $R_m$ is 630-800 MPa. Thus the strength values are about 70-170 MPa higher than the strength of the 316L/1.4404 type austenitic stainless steel. Further, the austenitic stainless steel of the invention has the PREN value greater than 24, and the $Cr_{eq}/Ni_{eq}$ ratio in the steel is less than 1.60 as well as the steel has $M_{d30}$ value less than −80° C.

The effects and the contents in weight % of the elements for the austenitic stainless steel of the invention are described in the following:

Carbon (C) is a valuable austenite forming and austenite stabilizing element. Carbon can be added up to 0.03% but higher levels have detrimental influence on corrosion resistance. The carbon content shall not be less than 0.01%. Limiting the carbon content to low levels carbon also increases the need for other expensive austenite formers and austenite stabilizers.

Silicon (Si) is added to stainless steels for deoxidizing purposes in the melt shop and should not be below 0.2% preferably at least 0.25%. Silicon is a ferrite forming element, but silicon has a stronger stabilizing effect on austenite stability against martensite formation. The silicon content must be limited below 0.6%, preferably below 0.55%.

Manganese (Mn) is an important additive to ensure the stable austenitic crystal structure, also against martensite deformation. Manganese also increases the solubility of nitrogen to the steel. However, too high manganese contents will reduce the corrosion resistance and hot workability. Therefore, the manganese content shall be at the range of 1.0-2.0%, preferably 1.6-2.0%.

Chromium (Cr) is responsible of ensuring corrosion resistance of the stainless steel. Chromium is a ferrite forming element, but chromium is also the main addition to create a proper phase balance between austenite and ferrite. Increasing the chromium content increases the need for expensive austenite formers nickel, manganese or necessitates impractically high carbon and nitrogen contents. Higher chromium content also increases beneficial nitrogen solubility to austenitic phase. Therefore, the chromium content shall be in the range 19-21%, preferably 19.5-20.5%.

Nickel (Ni) is a strong austenite stabilizer and enhances formability and toughness. However, nickel is an expensive element, and therefore, in order to maintain cost-efficiency of the invented steel the upper limit for the nickel alloying shall be 9.5%, preferably 9.0%. Having a large influence on austenite stability against martensite formation nickel has to be present in a narrow range. The lower limit for the nickel content is thus 7.5%, preferably 8.0%.

Copper (Cu) can be used as a cheaper substitute for nickel as austenite former and austenite stabilizer. Copper is a weak stabilizer of the austenite phase but has a strong effect on the resistance to martensite formation. Copper improves formability by reducing stacking fault energy and improves corrosion resistance in certain environments. If copper content is higher than 3.0% it reduces hot workability. In this invention the copper content range is 0.2-1.0%, preferably 0.3-0.6%.

Cobalt (Co) stabilizes austenite and is a substitute for nickel. Cobalt also increases the strength. Cobalt is very expensive and therefore its use is limited. If cobalt is added, the maximum limit is 1.0%, preferably less than 0.4%, and the range is preferably 0.1-0.3%, when cobalt naturally comes from recycled scrap and/or with nickel alloying.

Nitrogen (N) is a strong austenite former and stabilizer. Therefore, nitrogen alloying improves the cost efficiency of the invented steel by enabling lower use of nickel, copper and manganese. Nitrogen improves pitting corrosion resistance very effectively, especially when alloyed together with molybdenum.

In order to ensure reasonably low use of the above-mentioned alloying elements, nitrogen content shall be at least 0.1%. High nitrogen contents increase the strength of the steel and thus make forming operations more difficult. Furthermore, risk of nitride precipitation increases with increasing nitrogen content. For these reasons, the nitrogen content shall not exceed 0.25%, and the content is preferably at the range of 0.13-0.20%.

Molybdenum (Mo) is an element, which improves the corrosion resistance of the steel by modifying the passive film. Molybdenum increases the resistance to martensite formation. Lower molybdenum content decreases the likelihood of intermetallic phases such as sigma to form when steel is exposed to high temperatures. High Mo levels (>3.0%) decrease the hot workability and can increase delta ferrite (δ-ferrite) solidification to detrimental level. However, due to the high cost, the Mo content of the steel shall be at the range of 0.4-1.4% preferably 0.5-1.0%.

Boron (B) can be used for improved hot workability and better surface quality. The boron additions of more than 0.01% can be deleterious for workability and corrosion resistance of the steel. The austenitic stainless steel presented in this invention has boron optionally less than 0.006%, preferably less than 0.004%.

The properties of the austenitic stainless steel in accordance with the invention were tested with the chemical compositions of the table 1 for alloys A, B, C, D, E, F, G, H, I and J. The steel alloys A to I were made in laboratory scale with 65 kg cast slabs rolled down to a 5 mm hot band thickness and further cold rolled to a 2.2 or 1.5 mm final thicknesses. The steel alloy J was made in full scale through a very well-known stainless steel production route consisting EAF (Electric Arc Furnace)—AOD converter (Argon Oxygen Decarburization)—ladle treatment—continuous casting—hot rolling and cold rolling. The hot rolled strip thickness was 5 mm and the final cold rolling thickness 1.5 mm. The table 1 also contains the chemical composition of the 316L/1.4404 (316L) type austenitic stainless steel which was used as a reference.

TABLE 1

| Steel | C % | Si % | Mn % | Cr % | Ni % | Mo % | Cu % | N % | Co % |
|---|---|---|---|---|---|---|---|---|---|
| A | 0.028 | 0.43 | 1.81 | 19.8 | 8.5 | 0.99 | 0.52 | 0.148 | 0.01 |
| B | 0.027 | 0.40 | 1.79 | 20.2 | 8.0 | 0.88 | 0.49 | 0.183 | 0.01 |
| C | 0.028 | 0.44 | 1.81 | 20.5 | 8.5 | 0.78 | 0.52 | 0.201 | 0.01 |
| D | 0.024 | 0.44 | 3.75 | 20.7 | 7.1 | 0.69 | 0.52 | 0.202 | 0.01 |
| E | 0.022 | 0.44 | 1.77 | 20.1 | 8.5 | 0.78 | 0.52 | 0.180 | 0.25 |
| F | 0.021 | 0.42 | 1.82 | 20.2 | 8.6 | 0.68 | 0.51 | 0.204 | 0.25 |
| G | 0.017 | 0.47 | 1.76 | 20.3 | 8.6 | 0.59 | 0.50 | 0.222 | 0.01 |
| H | 0.019 | 0.44 | 1.78 | 20.5 | 8.1 | 0.49 | 0.52 | 0.252 | 0.25 |
| I | 0.022 | 0.42 | 1.81 | 20.2 | 8.2 | 0.54 | 0.51 | 0.216 | 0.20 |
| J | 0.018 | 0.53 | 1.81 | 20.3 | 8.7 | 0.71 | 0.48 | 0.207 | 0.13 |
| 316L | 0.017 | 0.48 | 1.78 | 17.0 | 10.1 | 2.03 | 0.39 | 0.047 | 0.24 |

For the chemical compositions A, B, C, D, E, F, G, H, I, J and 316L of the table 1 the chromium equivalent ($Cr_{eq}$) and the nickel equivalent ($Ni_{eq}$) were calculated using the following formulas (1) and (2):

$$Cr_{eq}=\%Cr+\%Mo+1.5\times\%Si+2.0\%Ti+0.5\times\%Nb \quad (1)$$

$$Ni_{eq}=\%Ni+0.5\times\%Mn+30\times(\%C+\%N)+0.5\%Cu+0.5\%Co \quad (2).$$

The predicted $M_{d30}$ temperature ($M_{d30}$) for the each steel of the table 1 was calculated using Nohara expression (3)

$$M_{d30}=551-462\times(\%C+\%N)-9.2\times\%Si-8.1\times\%Mn-13.7\times\%Cr-29\times(\%Ni+\%Cu)-18.5\times\%Mo-68\times\%Nb \quad (3),$$

established for austenitic stainless steels when annealed at the temperature of 1050° C. The $M_{d30}$-temperature is defined as the temperature at which 0.3 true strain yields 50% transformation of the austenite to martensite.

The pitting resistance equivalent number (PREN) is calculated using the formula (4):

$$PREN=\%Cr+3.3\times\%Mo+30\times\%N \quad (4).$$

The results for the chromium equivalent ($Cr_{eq}$), the nickel equivalent ($Ni_{eq}$), the ratio $Cr_{eq}/Ni_{eq}$, the $M_{d30}$ temperature ($M_{d30}$) and the pitting resistance equivalent number (PREN) are presented in the table 2.

TABLE 2

| Steel | $Cr_{eq}$ | $Ni_{eq}$ | $Cr_{eq}/Ni_{eq}$ | $M_{d30}$ ° C. | PREN |
|---|---|---|---|---|---|
| A | 21.44 | 14.95 | 1.43 | −100.1 | 27.5 |
| B | 21.71 | 15.45 | 1.41 | −103.9 | 28.6 |
| C | 21.94 | 15.84 | 1.39 | −110.1 | 29.1 |
| D | 22.05 | 16.02 | 1.38 | −105.2 | 29.0 |
| E | 21.54 | 15.78 | 1.37 | −111.0 | 28.1 |
| F | 21.51 | 16.64 | 1.29 | −125.4 | 28.6 |
| G | 21.60 | 16.91 | 1.28 | −131.3 | 28.9 |
| H | 21.65 | 17.51 | 1.24 | −132.9 | 29.7 |
| I | 21.37 | 16.60 | 1.29 | −117.1 | 28.5 |
| J | 21.81 | 16.66 | 1.31 | −130.0 | 28.9 |
| 316L | 19.78 | 13.23 | 1.50 | −76.2 | 25.1 |

The results of the table 2 show that the pitting resistance equivalent number (PREN) is higher, at the range of 27.0-29.5, for the austenitic stainless steel of the invention than for the reference stainless steel 316L (25.1). The ratio $Cr_{eq}/Ni_{eq}$ at the range of 1.20-1.45 is lesser for steels A-J of the invention than for the reference stainless steel 316L (1.50), indicating that the coefficient of nitrogen in nickel equivalent has strong effect on phase balance and can therefore be very useful for affordable alloying. The $M_{d30}$ temperature is lower than −100.1° C. for each austenitic stainless steel of the invention in the table 2 and also lower than the $M_{d30}$ temperature for the reference steel 316L and thus austenite stability against martensite transformation in the austenitic stainless steel of the invention is improved.

The measured ferrite contents in the cold rolled and annealed condition for the steel A-J are presented in table 3 which shows that the steel of the invention and the reference 316L austenitic stainless steel have essentially the equal amount of ferrite in the final microstructure.

TABLE 3

| Steel | Average ferrite content [%]* |
|---|---|
| A | 0.73 |
| B | 0.46 |
| C | 1.16 |
| D | 4.50 |
| E | 0.30 |
| F | <0.10 |
| G | <0.10 |
| H | <0.10 |
| I | <0.10 |
| J | <0.10 |
| 316L | 0.32 |

*minimum detection limit for measuring device was 0.10%

The proof strengths $R_{p0.2}$ and $R_{p1.0}$ as well as the tensile strength $R_m$ for the austenitic stainless steels A-J according to the invention were determined and are presented in the table 4 with the respective values of the standardized 316L austenitic stainless steel as a reference.

TABLE 4

| Steel | $R_{p0.2}$ MPa | $R_{p1.0}$ MPa | $R_m$ MPa |
|---|---|---|---|
| A | 352 | 406 | 668 |
| B | 372 | 421 | 686 |
| C | 394 | 448 | 680 |
| D | 397 | 452 | 697 |
| E | 372 | 414 | 688 |
| F | 396 | 438 | 720 |
| G | 409 | 449 | 733 |
| H | 421 | 465 | 747 |
| I | 414 | 455 | 723 |
| J | 383 | 402 | 727 |
| 316L standard | 170 | — | 485 |
| 316L typical | 260 | 285 | 600 |

As shown in the table 4 the determined strengths for the austenitic stainless steel of the invention are about 70-170

MPa higher than the respective strengths for the reference 316L austenitic stainless steel. Further, the austenitic stainless steel in accordance with the invention is essentially easily rolled in temper rolling conditions.

Austenitic stainless steel presented in this invention has same level of formability as reference material 316L even though the strength is notably higher. Formability test results are presented in table 5 and there is LDR (Limiting Drawing Ratio) and Erichsen Index. The limiting drawing ratio is defined as a ratio of the maximum blank diameter that can be safely drawn into a cup without flange to the punch diameter. LDR is determined with 50 mm flat head punch and 25 kN holding force. The Erichsen cupping test is a ductility test, which is employed to evaluate the ability of metallic sheets and strips to undergo plastic deformation in stretch forming. The test consists of forming an indentation by pressing a punch with a spherical end against a test piece clamped between a blank holder and a die, until a through crack appears. The depth of the cup is measured. Erichsen Index is an average value of 5 tests.

TABLE 5

| Steel | Thickness [mm] | LDR | Erichsen Index |
|---|---|---|---|
| A | 2.2 | 2.10 | 13.7 |
| B | 2.2 | 2.16 | 13.7 |
| C | 2.2 | 2.10 | 13.1 |
| D | 2.2 | 2.00 | 13.3 |
| E | 1.5 | 2.10 | 12.0 |
| F | 1.5 | 2.00 | 12.1 |
| G | 1.5 | 2.10 | 11.7 |
| H | 1.5 | 2.10 | 11.7 |
| I | 1.5 | 2.10 | 12.3 |
| J | 1.5 | 2.18 | 11.8 |
| 316L | 1.5 | 2.10 | 12.3 |

Nitrogen alloying with high chromium content and lowered molybdenum content in austenitic stainless steel presented in this invention yields remarkably higher pitting corrosion resistance when compared to reference material 316L. Results are presented in table 6. The pitting corrosion tests were done to ground specimen surface with Avesta cell in 1M NaCl solution at 35° C. temperature.

TABLE 6

| Steel | Breakdown potential Eb [mV] |
|---|---|
| A | 390 |
| B | 448 |
| C | 473 |
| D | 412 |
| E | 694 |
| F | 808 |
| G | 653 |
| H | 871 |
| I | 736 |
| J | 727 |
| 316L | 309 |

The results in the table 6 show that the breakdown potential i.e. the lowest potential when pitting corrosion occurs, is much higher for the austenitic stainless steel (Steels A-J) of the invention than for the reference material 316L.

The invention claimed is:

1. Austenitic stainless steel with improved pitting corrosion resistance and improved strength, characterized in that the steel contains in weight % less than 0.03% carbon (C) for austenite forming and stabilizing, such that higher levels of carbon reduce corrosion resistance, 0.2-0.6% silicon (Si), 1.0-1.82% manganese (Mn), 19.0-21.0% chromium (Cr) to ensure corrosion resistance, such that higher levels of chromium increases the need for more nickel, manganese, carbon and/or nitrogen, 7.5-9.5% nickel (Ni), 0.4-1.4% molybdenum (Mo) that improves corrosion resistance by modifying the passive film, such that higher levels of molybdenum decreases the hot workability and increases delta ferrite solidification to a detrimental level, 0.2-1.0% copper (Cu), 0.10-0.25% nitrogen (N), optionally less than 1.0% cobalt (Co), optionally less than 0.006% boron (B), and the rest being iron (Fe) and inevitable impurities, and that the steel has the proof strength $R_{p0.2}$ 320-450 MPa and the proof strength $R_{p1.0}$ 370-500 MPa, the tensile strength $R_m$ is 630-800 MPa, the pitting resistance equivalent number (PREN) value is greater than 24, and the $Cr_{eq}/Ni_{eq}$ ratio is less than 1.43; wherein $Cr_{eq}$=%Cr+%Mo+1.5×%Si+2.0%Ti+0.5×%Nb and $Ni_{eq}$=%Ni+0.5×%Mn+30×(%C+%N)+0.5%Cu+0.5%Co.

2. Austenitic stainless steel according to the claim 1, characterized in that the steel contains 0.25-0.55 weight % silicon.

3. Austenitic stainless steel according to the claim 1, characterized in that the steel contains 1.6-1.82 weight % manganese.

4. Austenitic stainless steel according to claim 1, characterized in that the steel contains 19.5-20.5 weight % chromium.

5. Austenitic stainless steel according to claim 1, characterized in that the steel contains 8.0-9.0 weight % nickel.

6. Austenitic stainless steel according to claim 1, characterized in that the steel contains 0.5-1.0 weight % molybdenum.

7. Austenitic stainless steel according to claim 1, characterized in that the steel contains 0.3-0.6 weight % copper.

8. Austenitic stainless steel according to claim 1, characterized in that the steel contains 0.13-0.20 weight % nitrogen.

9. Austenitic stainless steel according to claim 1, characterized in that the steel contains less than 0.4 weight % cobalt.

10. Austenitic stainless steel according to claim 1, characterized in that the steel contains less than 0.004 weight % boron.

11. Austenitic stainless steel according to claim 1, characterized in that the $Cr_{eq}/Ni_{eq}$ ratio is between 1.24 and 1.43.

12. Austenitic stainless steel according to claim 1, characterized in that the steel has $M_{d30}$ temperature less than −80° C.

* * * * *